US005685953A

United States Patent [19]

Solinas et al.

[11] Patent Number: 5,685,953

[45] Date of Patent: Nov. 11, 1997

[54] OZONE BLEACHING WITH AN ORGANIC SOLVENT AND MINERAL ACID

[75] Inventors: Marco Solinas, Vancouver; Thomas Howard Murphy, Burnaby; Adriaan Reinhard Pieter van Heiningen, New Brunswick; Yonghao Ni, Fredericton, all of Canada

[73] Assignee: MacMillan Bloedel Limited, Vancouver, Canada

[21] Appl. No.: 489,077

[22] Filed: Jun. 9, 1995

(Under 37 CFR 1.47)

Related U.S. Application Data

[63] Continuation of Ser. No. 56,496, May 3, 1993, abandoned, which is a continuation-in-part of Ser. No. 980,068, Nov. 23, 1992, abandoned, which is a continuation-in-part of Ser. No. 966,639, Oct. 23, 1992, abandoned.

[51] Int. Cl.[6] ..... D21C 9/153; D21C 9/16

[52] U.S. Cl. ..... 162/65; 162/77; 162/78

[58] Field of Search ..... 162/23, 65, 77, 162/78

[56] References Cited

U.S. PATENT DOCUMENTS

| | | | |
|---|---|---|---|
| 4,229,252 | 10/1980 | Meredith | 162/65 |
| 4,450,044 | 5/1984 | Fritzvold et al. | 162/65 |

FOREIGN PATENT DOCUMENTS

| | | |
|---|---|---|
| 90403 | 1/1977 | Japan . |
| 4910778 | 5/1978 | Japan . |

OTHER PUBLICATIONS

"Effect of Cellulose Protectors on Ozone Bleaching of Kraft Pulp", Journal of the Japanese Technical Association of Pulp and Paper Industry, vol. 31, No. 9, Sep. 1977, pp. 62–70 by Hiroshi Kamishima, Toshiro Fujii, Isao Akamatsu.

"Ozone Bleaching of Kraft Pulps", S. Rothenberg and D. Johnsonbaugh, Empire State Paper Research Institute, State University College of Forestry at Syracuse Univ, Supplement to Research Paper No. 53 to State Paper Research Associates Inc, Apr. 12, 1971, pp. 13–18.

"Ozone Bleaching of Kraft Pulps", S. Rothenberg and D. Johnsonbaugh, Empire State Paper Research Institute, State University College of Forestry at Syracuse Univ, Research Paper No. 54 to Empire State Paper Research Associates Inc. Oct. 1, 1971, pp. 21–28.

*Primary Examiner*—Steven Alvo
*Attorney, Agent, or Firm*—C. A. Rowley

[57] ABSTRACT

A bleached pulp having a high viscosity for a given permanganate number is formed by pretreating never dried pulp with an organic solvent medium to produce a treated pulp composed of said never dried pulp in the medium and then bleaching that treated pulp using ozone at a pH of 1.5–5 to provide a bleached pulp while reducing the viscosity loss during the ozone bleaching step significantly compared to that what would occur if the medium used in the ozone bleaching were water.

14 Claims, 5 Drawing Sheets

OZONE BLEACHING WITH AN ORGANIC SOLVENT AND MINERAL ACID

This application is a continuation of application Ser. No. 08/056,496, filed May 3, 1993, abandoned which in turn is a continuation-in-part of application Ser. No. 07/980,068 filed Nov. 23, 1992, which in turn is a continuation-in-part of application Ser. No. 07/966,639 filed Oct. 23, 1992, both now abandoned.

FIELD OF THE INVENTION

The present invention relates to bleached chemical pulps bleached with ozone while suspended in an organic medium.

BACKGROUND OF THE INVENTION

It is known to treat paper making pulps with alcohols and then subject them to ozone bleaching, the concept being that the alcohol acts as a protector for the cellulose during the ozone bleaching stage. None of these processes have proven to be particularly effective and in fact some have shown the use of ethanol led to detrimental effects.

U.S. Pat. No. 4,229,252 issued Oct. 21, 1980 to Meredith employed a small amount of ethanol during ozone bleaching to enhance the bleaching. The concentration of alcohol was in the range of 0.0000001 to 0.03 moles per liter in the liquid phase. Only slight improvements in delignification were obtained.

Japanese patent 78-49107 published May 4, 1978 by Ueshima discloses a process for recovering methanol from the digestion of wood chips with NaOH and $Na_2S$ and employs this recovered and separated methanol as a protector for the wood pulp during an ozone bleaching stage. The results shown indicate an increase in viscosity from 5.8 (control) to about 14 or an 8 point increase in viscosity at an ozone consumption in the order of about 3% by weight on an air dried pulp impregnated with a fluid substantially free of water using a neutral pH during the ozone stage.

Japanese patent 78-90403 published Aug. 9, 1978 Ueshima et al shows results similar to but not as good as those described above with respect to Japanese patent 78-49107. 78-90403 describes the use of a water free liquor containing methanol surrounding the pulp during an ozone bleaching stage carried out at neutral pH on air dried pulp.

In an article entitled *The Effect of Cellulose Protectors on Ozone Bleaching of Kraft Pulp* by Kamisima in the Journal of Japanese Technical Association of the Pulp and Paper Industry, Vol. 31, No. 9, September, 1977, pp 62–70 there is disclosed a number of different organic solvents that may be used to protect the pulp during an ozone bleaching stage. This publication indicates that ethanol is not effective in improving the viscosity of ozone bleached pulp, in fact it shows a negative result whereas the use of methanol produces a positive result of about 3 to 4 cp improvement in viscosity. In these teachings air dried pulp is treated with the organic solvents (alcohols) substantially free of water and then bleached with ozone at neutral pH while the pulp is suspended in the organic solvent medium.

Empire State Paper Research Institute, supplement to Research Report No. 53, titled *Ozone Bleaching of Kraft Pulps* by Rothenberg et al., Apr. 12, 1971, describes the use of various organic solvents as the medium surrounding the chips during ozone bleaching. It concludes that ethanol is a good protecting agent for the cellulose and indicates that the protection of the cellulose depends only upon the concentration of ethanol in the aqueous steeping medium applied to the pulp. The efficiency of the system continually improved as in the concentration of ethanol was increased up to the maximum concentration tested, namely 35% ethanol by volume in water.

Empire State Paper Research Institute, Report No. 54, titled *Ozone Bleaching of Kraft Pulps* by Rothenberg et al., October 1971, further reports on the use of ethanol (and other organic solvents) together with 1% acetic acid as the medium in ozone bleaching. The results reported indicate that as the percentage ethanol in the medium was increased above 35%, the resulting brightness of the pulp and the bleaching selectivity decreased. The results further indicate that at a similar brightness, there was about 6.5 cp gain in viscosity using the ethanol and acetic acid medium.

BRIEF DESCRIPTION OF THE PRESENT INVENTION

It is an object of the present invention to provide an improved ozone bleached chemical pulp having a viscosity significantly higher than conventionally produced ozone pulp at a given permanganate or kappa number.

It is also an object of the present invention to provide a method of producing such an ozone bleached pulp.

Broadly the present invention relates to an ozone bleached chemical pulp having a viscosity equivalent to a viscosity of at least 20 cp at a permanganate number of 6 ml for northern softwood kraft pulp.

Preferably the pulp will have an increase in viscosity of at least 9 cp over the same pulp conventionally ozone bleached under the same conditions but in an aqueous medium in place of the low dielectric constant medium without an extraction stage following the ozone stage and at least about 10 cp higher for northern softwood than conventional ozone bleaching when a caustic extraction stage is used after the ozone stage.

Preferably said bleached pulp will have a viscosity equivalent to a viscosity of at least 25 cp at a permanganate number of 6 ml.

Preferably said pulp will be a totally chlorine free pulp.

Broadly the present invention also relates to a method of producing an ozone bleached pulp comprising pretreating a never dried pulp with an aqueous medium including a water miscible organic solvent having a dialectic constant of no more than 40 to produce a treated pulp composed of said pulp in said aqueous organic medium containing at least 10% by weight of said solvent, bleaching said treated pulp with ozone in an ozone bleaching stage at a pH of 1.5 to 5 to provide a bleached pulp having a viscosity at least 25% higher than would be obtained bleaching the same pulp under the same conditions but using an aqueous medium in place of said aqueous organic medium.

Preferably said organic solvent will be selected from selected from the group consisting of ethanol or methanol.

Preferably said organic solvent will comprise methanol.

Preferably said aqueous organic medium will contain at least 50% of said organic solvent.

Preferably said ozone bleaching stage .will be a medium or high consistency ozone bleaching stage and said consistency will be in the range of 6–65%.

Preferably said ozone bleaching stage will be a high consistency ozone bleaching stage and said consistency will be in the range of 35–45%.

BRIEF DESCRIPTION OF THE DRAWINGS

Further features, objects and advantages will be evident from the following detailed description of the present invention taken in conjunction with the accompanying drawings in which.

DESCRIPTION OF THE PREFERRED EMBODIMENTS

Figure 1:
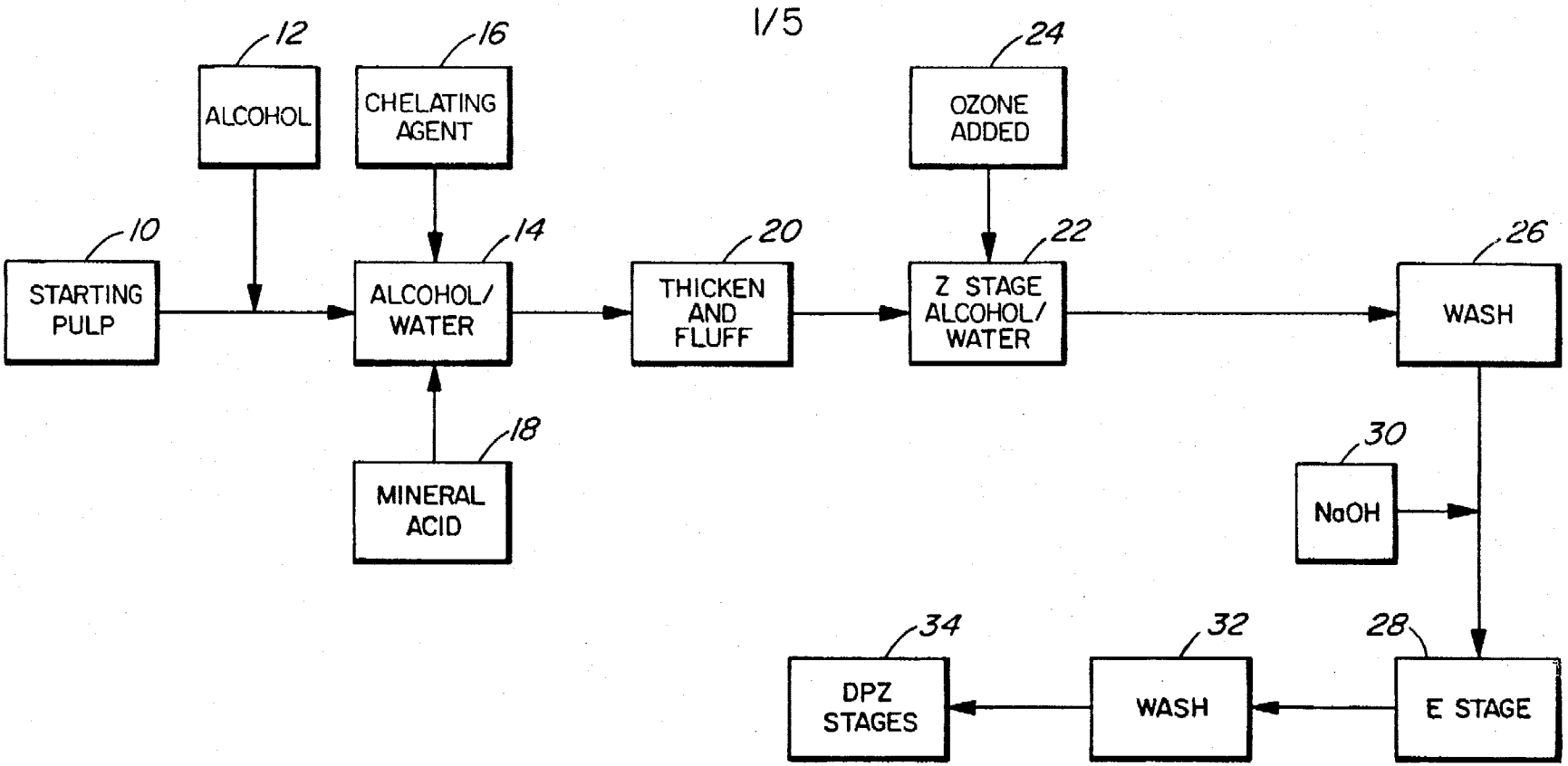
FIG. 1 is a schematic illustration of an embodiment of a process for producing the bleached pulp of the present invention.

As shown in FIG. 1, the starting pulp, i.e. brown stock, enters the system as indicated at 10 and may contain pulp at a consistency of about 30% normally in water. This pulp is then diluted as indicated at 12 with an aqueous organic medium containing a water missable solvent (alcohol) and water in amounts to obtain an aqueous medium containing the desired amount of solvent surrounding the pulp and to obtain the desired consistency of the pulp in the medium as indicated at 14. A suitable chelating agent may be added as indicated at 16. Also the pH of the pulp is adjusted to that to be used in the ozone or Z stage by the addition of the appropriate amount of a mineral acid, preferably sulphuric acid and as indicated at 18.

It is very important that the aqueous organic medium be thoroughly mixed with the pulp, i.e. so that the organic solvent is uniformly distributed through the pulp and provides the desired concentration of organic solvent in the medium in direct contact with the pulp.

The pulp is then thickened and fluffed (assuming a high consistency ozone stage 22) as indicated at 20 to produce a treated pulp in the solvent and water medium and is introduced to the ozone stage 22 (Z stage). Ozone in the desired amount is introduced as indicated at 24.

After treatment with ozone in the Z stage 22 under the appropriate conditions as will be described in more detail hereinbelow, the pulp is passed through a washing stage 26 and the P. No. and viscosity of the pulp measured (during experimental investigation).

The washed pulp from the washing stage 26 passes into an extraction stage (E stage) 28 wherein sodium hydroxide is added as indicated at 30 and the pulp diluted to the required consistency. The bleached pulp is normally retained for about an hour at a temperature of about 70° for the alkaline extraction. The pulp is then washed and the P. No. and viscosity again measured as indicated at 32.

It is very important when carrying out the Z stage at higher consistencies (above 20%) to ensure that the medium impregnated pulp is thoroughly fluffed as indicated at 16 so the particle size of the pulp during the ozone stage 22 (Z stage) is small to permit easy access of the ozone to all fibres through the medium.

As indicated at 34 the pulp may be taken from the wash stage 32 and further bleached, for example with chlorine dioxide in one or more stages (D stages) or peroxide in one or more stages (P stages) or with ozone (in one or more Z stages) or with any combination of the above.

A never dried pulp, e.g. kraft pulp or another suitably delignified pulp is treated with a organic solvent (alcohol) as indicated at 12 to displace the majority of the water surrounding the pulp (14) and form a treated pulp composed of the pulp in an aqueous organic solvent medium (20). For example, a kraft pulp at a consistency in the order of 20–40% may be diluted with a suitable organic solvent preferably methanol or ethanol (e.g. denatured ethanol) to a low consistency of below about 15% to produce an aqueous organic solvent (alcohol) medium surrounding the fibres. The medium should contain at least 10% alcohol and preferably at least 50% and more, preferably about 75%. The medium always contains at least 10% water and in most cases will contain more than 10% water. The pulp so-treated is then acidified with a suitable mineral acid preferably $H_2SO_4$ (18) to adjust the pH to the pH to be used during the ozone stage, i.e. 1.5–5, and a chelating agent such as conventionally used diethylene triamine pentacetic acid (DTPA) may be added (16).

The ozone bleaching process of the present invention has been found to be more gentle on the pulp, i.e. create less degradation than the normal ozone pulping operation and in most cases better than a conventional oxygen delignification stage thus it is possible, in fact preferable, that the pulp introduced to the Z stage 22 have a relatively high kappa number (in all of the examples the brown stock was used having a kappa number of about 30 ml). If the material fed to the ozone stage of the present invention has already been delignified to a relatively low kappa number the opportunity for maintaining strength (viscosity) is reduced and for this reason it is preferred that the kappa number of the pulp fed to the ozone stage have a permanganate number of at least 22 and preferably at least 25 ml.

The so-treated pulp in the solvent medium is then thickened (20) to the consistency desired for ozone bleaching.

The ozone bleaching stage (Z stage) 22 used may be any conventional ozone bleaching stage. Care must be taken to guard against fire and explosion, thus, it is preferred to use nitrogen rather than oxygen as the carrier gas for the ozone. It has been found that high consistency ozone bleaching produces very beneficial results and thus it is preferred to increase the consistency of the treated pulp fed to the ozone stage to the order of 30–65% and to fluff the pulp before ozone treatment using the known techniques. It has been found that the consistency of the pulp may be increased beyond the normal 45% obtained with water to above 65% with the solvent medium so that the ozone bleaching stage may be carried out at higher consistencies in the order of 60 or possibly higher when the bleaching in the organic medium.

The conditions used in ozone bleaching using the present invention, i.e. with the aqueous organic medium surrounding of the pulp fibres requires a pH of 1.5–5. The temperature, amount of ozone applied and other conditions in the ozone treatment stage will be substantially conventional, i.e. as well known in the art. However, the temperature may be reduced to below room temperature, i.e., to a temperature approximately 0° C. for the Z stage and, as above indicated, the consistency during this Z stage, if desired, may be higher than the consistency normally used in the prior art.

The bleached pulp produced using the present invention generally has an improvement in viscosity of at least 25% at a selected permanganate number in the range of about 1.5 to 10 ml over a conventional ozone treated pulp bleached with the same amount of ozone. The ozone bleached pulps of the present invention generally have viscosities equivalent to viscosities of at least 20 cp at a permanganate number of 6 ml for northern softwood pulps or when subject to caustic extraction a viscosity equivalent to a viscosity of at least 20 cp at a permanganate number of 5 ml for northern softwood pulps.

Applicant has also found that ozone bleached pulps of the present invention react more favourably to further bleaching steps such as peroxide and it is suspected that they would behave similarly with respect to chlorine dioxide bleaching or further ozone stages.

With respect to totally chlorine free bleaching using the present invention followed by conventional peroxide bleaching stage(s) (P stage(s)), applicant has been able to produce significantly brighter pulps with significantly higher viscosities than those that could be obtained following the prior art techniques. Specifically applicant has peroxide bleached ozone bleached pulps bleached using the present invention to produce pulps having an ISO brightness of at least 3% and generally 5% higher than conventional ozone-peroxide bleached pulps (e.g. OZEP) and with significantly smaller reductions in viscosity. The peroxide bleaching of pulps made using the present invention in the Z stage produced pulps with significantly higher viscosities at a given permanganate number and at a given brightness than those obtained by the conventional process. The present invention permits the production of a totally chlorine free bleached pulp of at least 85% iso-brightness having a viscosity at least 12 and generally higher than 15 cp which heretofore could not be achieved.

EXAMPLE 1

Different quantities of ozone were applied to fluffed northern softwood Kraft brown stock having a kappa number of 30.5 ml and a viscosity of 31.5 cp. In the ozone stage the process followed conventional practice to provide a control. The following conditions were maintained in the control ozone bleaching stage; pH 2.25, temperature 20° C., consistency 40%, ozone applied 1 or 2% based on the dry weight of the pulp, ozone consumed 0.75 or 1.6% based on the dry weight of the pulp and reaction times were between 3–6 minutes.

In the control the dispersing medium or surrounding medium in the ozone stage was 100% water.

Figure 2:
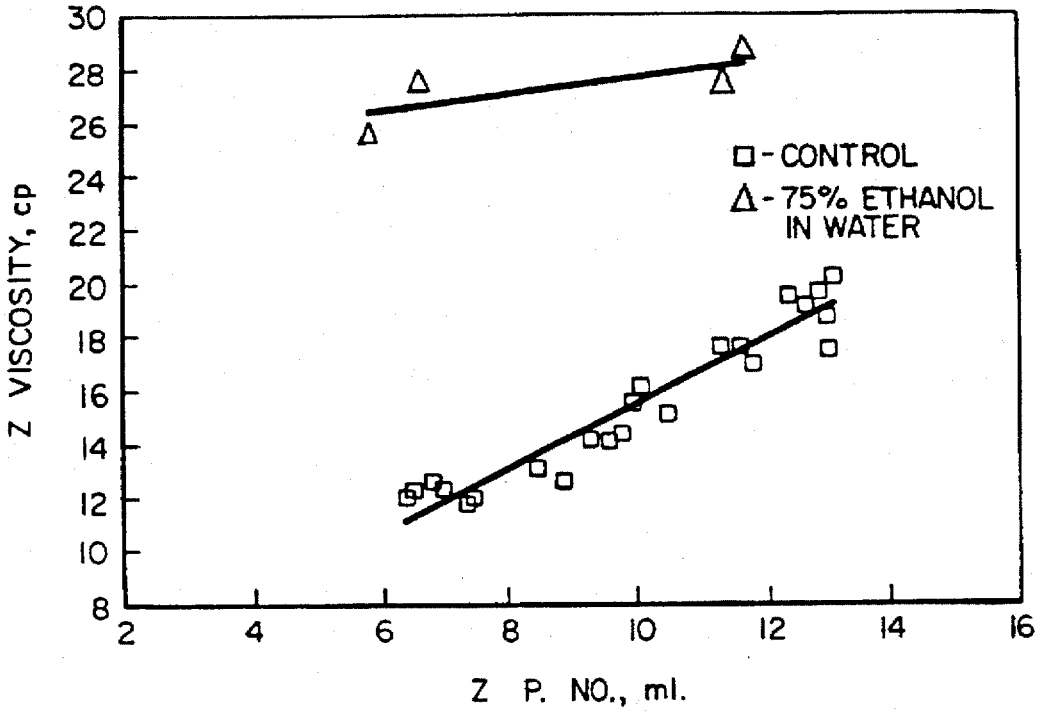
FIG. 2 demonstrates the effect of ozone bleaching in an ethanol medium on the viscosity vs permanganate number (P.No.) of the pulp compared with an ozone bleached control using ethanol at 75% concentration in water.
Figure 3:
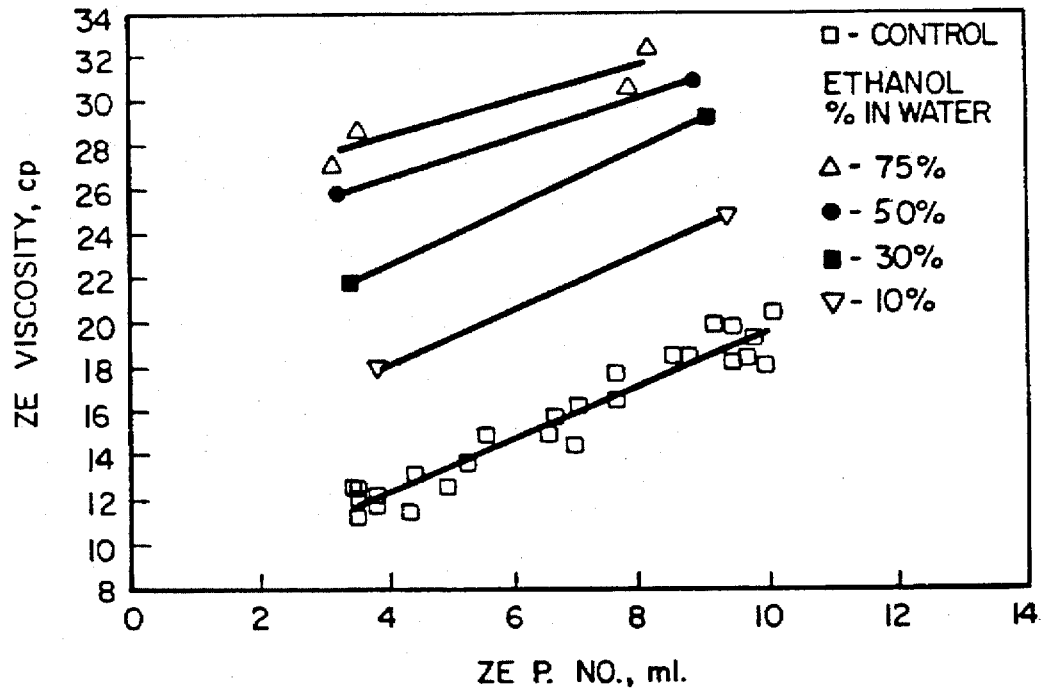
FIG. 3 is similar to FIG. 2 illustrating the effect on viscosity after ozone bleaching in an ethanol medium followed by a conventional extraction stage but using different concentrations of ethanol in water.

The results obtained in the control after washing are indicated by open squares in FIGS. 2 and 3. It can be seen in FIG. 2 that after the Z stage at a permanganate number of about 8 ml the viscosity was less than 13 cp and as indicated in FIG. 3 following an extraction stage at a permanganate number of 8 ml the viscosity was in the order of about 17 cp. To maintain a viscosity of 20 cp for the control in FIG. 2 the P.No. needed to be at least 13 ml and after extraction (FIG. 3) the P.No. needed to be about 10 ml.

EXAMPLE 2

The brown stock from the same sample as Example 1 30% consistency (30% kraft fibre and 70% water) was diluted to 3% consistency using a mixture of denatured alcohol (85% ethanol and 15% methanol) and water to produce a medium surrounding the fibres after treatment containing 75% denatured alcohol and 25% water.

The pulp was acidified using $H_2SO_4$ down to a pH of 2.25 and 0.5% of DTPA based on the oven dry weight of the pulp was applied.

The treated pulp, i.e. in the ethanol medium was thickened (by centrifuging in the laboratory) to a consistency of 40%, then fluffed (using the same procedure as used for the control pulp) and then bleached with ozone in the same manner as the control described in Example 1.

The results obtained after washing are indicated by filled triangles in FIG. 2. It is clear that at a permanganate number of approximately 12 ml the pulp had a viscosity of about 28 cp and at a permanganate number in the order of 7 ml the viscosity of the pulp was just slightly under 27 cp, thereby indicating a change in viscosity of about 1 cp for a change in permanganate number in the order of 5 ml. These results also show a very substantial improvement in viscosity for a given permanganate number over the control of Example 1, i.e. at a permanganate number of 7 ml the viscosity was at least 26 cp and was 14 cp higher than the control (more than 100% higher). Viscosity gains of this magnitude have never been reported before and were totally unexpected.

EXAMPLE 3

Brown stock as described in Example 2 was treated as described but in a manner to change the composition of the medium surrounding the pulp to contain 10, 30 and 50% ethanol (denatured alcohol) in water and then treated with ozone as above described.

The pulps from Examples I (the control) and Example 2 (the 75% ethanol medium pulp) and the 10, 30 and 50% ethanol medium pulps were extracted using the conventional caustic extraction process at a temperature of 70° C, retention time 60 minutes, consistency 10% using 1.5% NaOH on the pulp. The permanganate number and viscosity were measured after washing each of the pulps and these results are shown by a) control=□
b) 75% alcohol medium Δ(from Example 2)
c) 50% alcohol medium ●
d) 30% alcohol medium ■
e) 10% alcohol medium ▽ in FIG. 3. The viscosity of the extracted pulp at a permanganate number of 4–5 ml when employing ethanol is about 28 cp for 75% alcohol medium and 18 cp using a 10% ethanol medium as compared with 13 cp following the conventional process, i.e. an increase of at least 5 cp with 10% alcohol (more than a 50% increase) and of at least about 15 cp with a 75% ethanol medium (more than a 100% increase).

It will be apparent that in all cases (Examples 2 and 3) the use of the ethanol medium surrounding the pulp during the ozone bleaching resulted in a minimum increase in viscosity over the control of 5 cp points and thus produced pulp having a significantly higher or better viscosity (which is a clear indication of pulp having better physical characteristics) than that obtained using conventional ozone bleaching.

EXAMPLE 4

A brown stock with a kappa number of 29.9 ml and a viscosity of 27.5 cp was treated via two different processes identified in Table 1 as process 1 and process 2; process 1 representing the prior art and process 2 the present invention.

Both of the processes consisted essentially of the same process steps, namely an oxygen stage (O); an ozone stage (Z)—prior art, or Ze present invention with ethanol; an oxygen assisted extraction stage ($E_O$); a heavy metal decontamination stage (Q); and two peroxide bleaching stages ($P_1P_2$).

Table 1 indicates the conditions used in each of the stages and defines the results obtained, i.e. delignification, brightness and viscosity.

It will be apparent that the pulp entering the Z stage after oxygen treatment will have a significantly lower kappa number than that entering the Ze stage since the conditions used in the O stage of the present invention resulted only in 27% delignification as compared with 53.5% delignification for the conventional oxygen stage.

The higher delignification in the O stage of conventional ozone bleaching process is used as with the conventional ozone bleaching it is advantageous to reduce the kappa number significantly in the oxygen stage before entering the Z stage. However with the present invention it is preferred not to so reduce the kappa number, i.e. use a milder O stage or no O stage.

Obviously the Z and Ze stages do significantly different amounts of delignification with the Z stage delignifying the pulp to obtain a ISO brightness of 62.9% as compared with the present invention Ze delignifying to produce a brightness of 65.2% and consuming 1.17% ozone as compared with 0.72% consumed using the prior art process.

The E stage in both cases is essentially the same. However the brightness gained by its extraction using the prior art process (process 1) resulted in a 4% increase in brightness whereas the present invention only produced a 2% increase in 180 brightness.

The Q stage is essentially the same in both cases.

The $P_1$ stage in both cases were essentially the same however the increase in ISO brightness in the P stage following the present invention was 3.7% higher than the conventional pulp although both entered the peroxide stage at essentially the same brightness.

Similarly in the following or second P stage P2 to obtain approximately a 1% increase in iso-brightness, the prior art required the application of about 0.7% hydrogen peroxide on the pulp (a consumption of about 0.4% hydrogen peroxide) while the present invention for an increase in brightness over 1% required the application of only 0.3% hydrogen peroxide and the actual consumption of less than 0.1% hydrogen peroxide, i.e. ¼ the peroxide consumption for a greater gain in brightness.

It will be apparent that in both the $P_1$ and $P_2$ stages the effectiveness of hydrogen peroxide bleaching is significantly enhanced by bleaching the pulp in an ozone stage incorporating the present invention.

A very important benefit of the present invention is the final viscosity of the bleached pulp which for the conventional process was about 10.2 cp as compared with the present invention that had a viscosity of 16.8, i.e. the present invention reproduced a totally chlorine free bleached pulp of over 4% higher iso-brightness, i.e. a brightness of 87.4% at a viscosity over 6.5 cp higher than the viscosity of the lower brightness conventionally produced pulp.

TABLE 1

Bleaching Sequence for Totally Chlorine Free (TCF) pulp.
Brown stock: kappa no. 29.9 ml
Viscosity 27.5 cp

| Sequences | Process 1 $OZE_OQPP$ | Process 2 $OZeE_OQPP$ |
|---|---|---|
| O Stage | | |
| NaOH, % on pulp | 2.4 | 1.9 |
| DTPA, % on pulp | 0.5 | — |
| $MgSO_4$, % on pulp | 1.0 | — |
| Kappa no., ml | 13.9 | 21.8 |
| Delignification, % | 53.5 | 27.0 |
| Z, Ze Stages | | |
| $O_3$, % consumed | 0.72 | 1.17 |
| DTPA, % on pulp | 0.5 | 0.5 |
| $H_2SO_4$, % on pulp | 0.08 | 0.22 |
| Ethanol conc., % | — | 50 |
| P. No., ml | 3.8 | 4.1 |
| Brightness, % ISO | 62.9 | 65.2 |
| $E_O$ Stage | | |
| NaOH, % on pulp | 1.5 | 1.5 |
| P. No., ml | 1.5 | 1.6 |
| Brightness, % ISO | 67.0 | 67.4 |
| Q Stage | | |
| DTPA, % on pulp | 0.2 | 0.2 |
| $MgSO_4$, % on pulp | 0.2 | 0.2 |
| $H_2SO_4$, % on pulp | 0.14 | 0.13 |
| $P_1$ Stage | | |
| $H_2O_2$, % on pulp | 1.0 | 1.0 |
| Residual, % on pulp | 0.59 | 0.56 |
| NaOH, % on pulp | 1.2 | 1.2 |
| $MgSO_4$, % on pulp | 0.2 | 0.2 |
| Brightness, % ISO | 82.4 | 86.1 |
| $P_2$ Stage | | |
| $H_2O_2$, % on pulp | 0.7 | 0.3 |
| Residual, % on pulp | 0.31 | 0.21 |
| NaOH, % on pulp | 1.2 | 0.8 |
| $MgSO_4$, % on pulp | 0.2 | 0.2 |
| Brightness, % ISO | 83.3 | 87.4 |
| Viscosity, cp | 10.2 | 16.8 |

EXAMPLE 5

Figure 4:
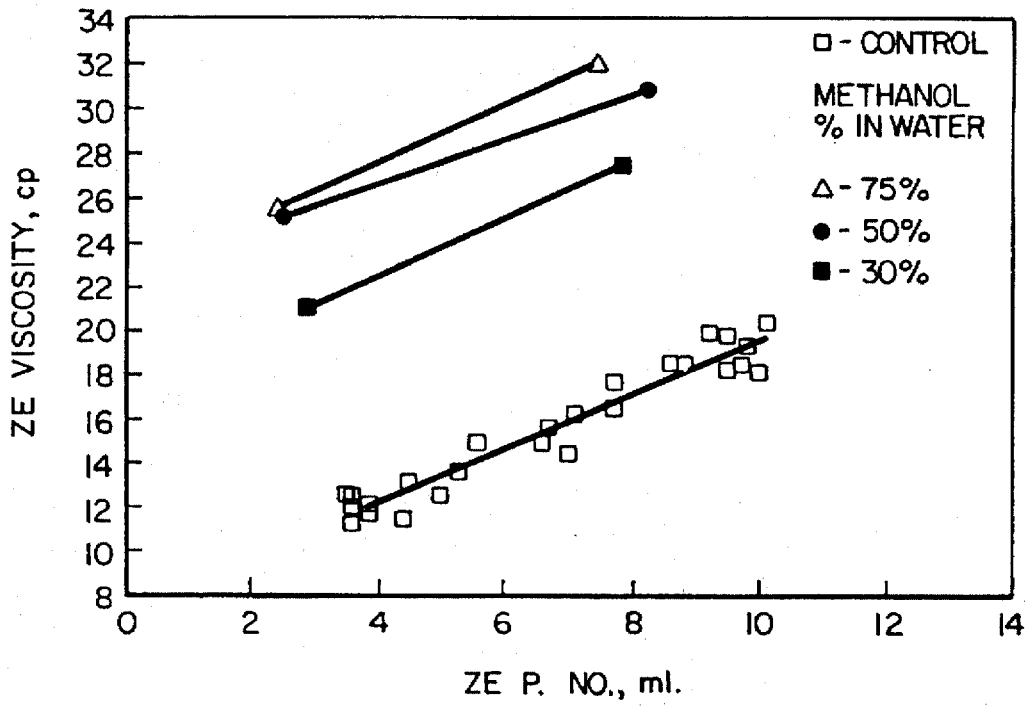
FIG. 4 is similar to FIG. 3 but the aqueous medium contains methanol in place of ethanol.

The same brown stock as used in Examples 1–3 was treated with methanol in place of the ethanol to provide treated, i.e. pulps contained in organic solvent mediums having 75%, 50% and 80% methanol and the treated pulp was bleached with ozone as described in Example 3 and tested after the E stage. The results obtained are shown in FIG. 4 with the symbols being the same as those used in FIG. 3 for the equivalent percentage of alcohol in the surrounding medium.

When methanol was used comparing the results at a P.No. of 4 ml, the viscosity increased from about 12 cp for the control to a maximum of about 28 cp for the 75% methanol, between 26 cp and 27 cp for 50% methanol and over 22 cp for 30% methanol showing a minimum increase of about 10 cp at a P.No. of 4 ml (50% increase). Quite clearly this is a very significant and unprecedented increase in viscosity.

EXAMPLE 6

Tests were carried out using the 50% ethanol medium but operating the ozone stage at pH of 2.25 or 7 (neutral).

Figure 5:
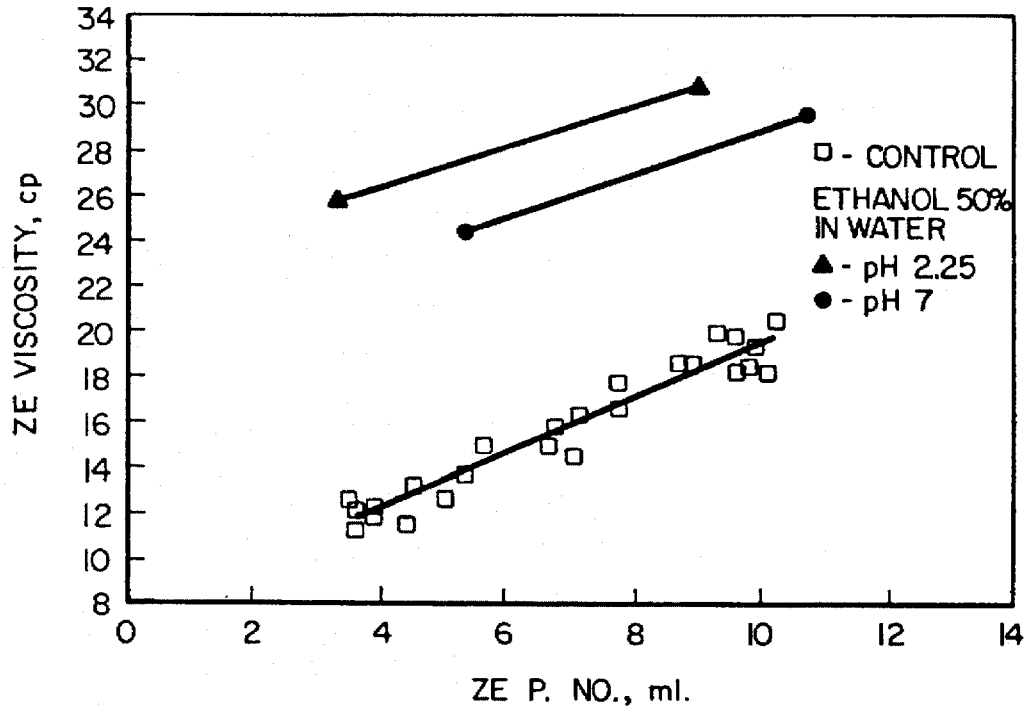
FIG. 5 shows the effect of pH during the ozone stage on the relationship of pulp viscosity vs. P.No.

It will be apparent from FIG. 5 that an improvement of at least 3 cp was obtained by operating at a pH of 2.25 as compared with a pH of 7 (pH 2.25 indicated by the solid triangle and pH 7 indicated by the solid circle).

Figure 6:
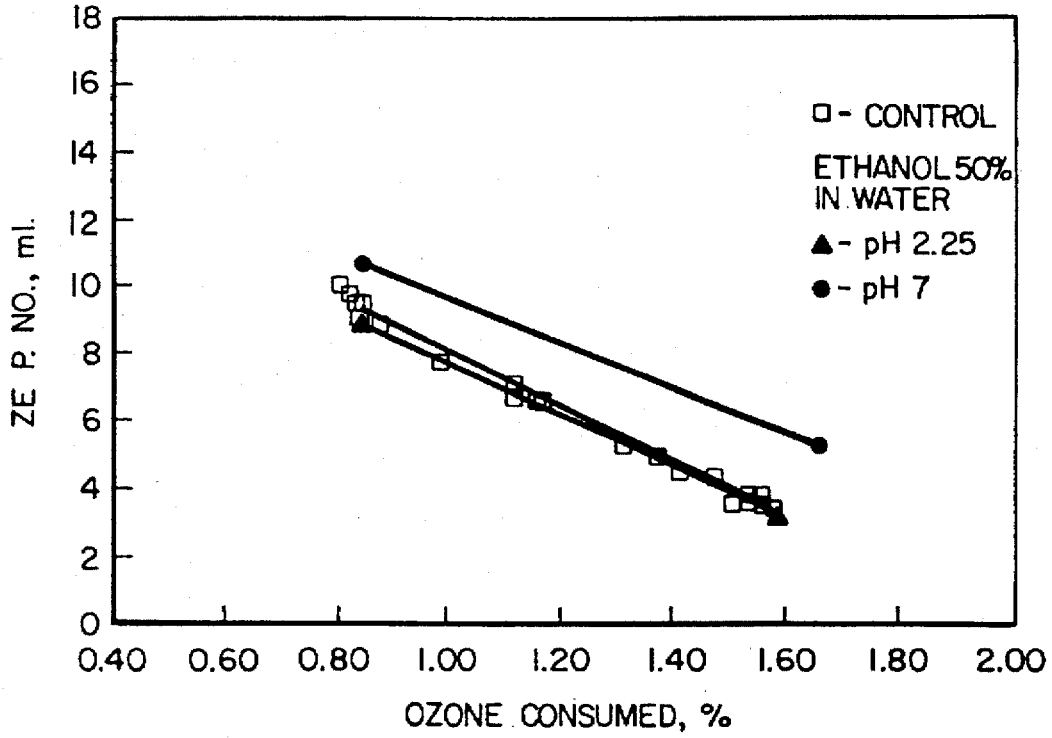
FIG. 6 shows the effect of pH on ozone consumed vs. P.No.

It will also be apparent from FIG. 6 (wherein the solid triangle again represent a pH of 2.25 and the solid circle a pH of 7) that the bleaching efficiency is higher at pH 2.25 than at pH 7, i.e. for a given amount of ozone consumed at a pH of 7 the delignification is less than in the control and at a pH of 2.25 the delignification is essentially the same as the control indicating that the pH is important for both improvement in viscosity and effective use of ozone, i.e. minimizing ozone consumption.

EXAMPLE 7

Figure 7:
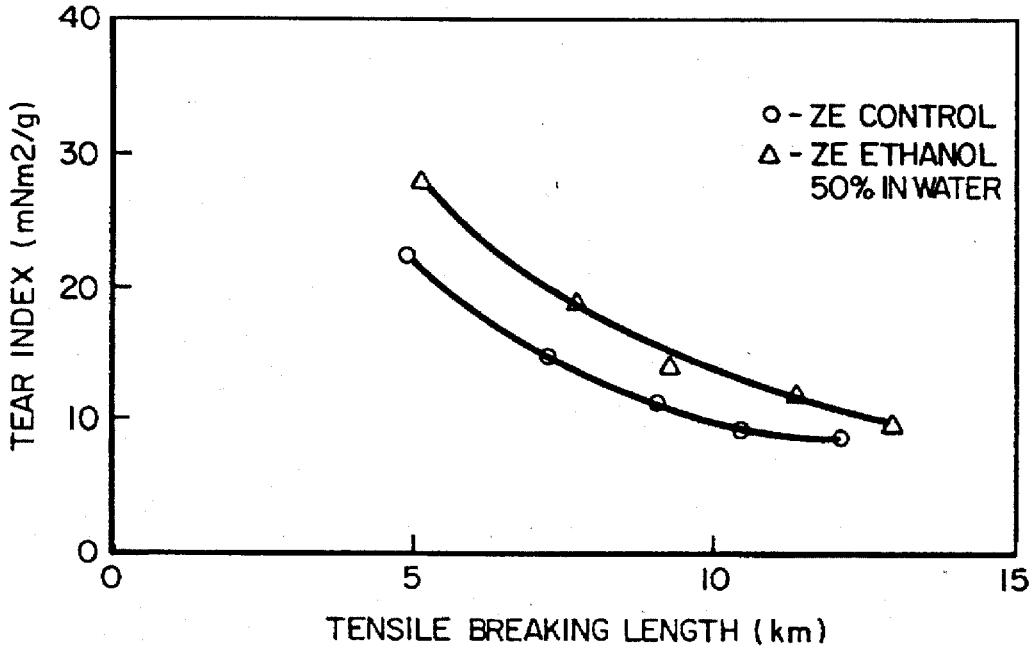
FIG. 7 shows plots of Tensile Breaking Length vs Tear Index illustrating that the increase in viscosity corresponds with an increase in pulp strength.

To determine the strength characteristics of the resultant pulp strength tests were made on the pulp from Example 3. The curve of tear index versus tensile breaking length shown in FIG. 7 clearly indicates the strength characteristics of the ethanol treated pulp (75% concentration in the surrounding medium) (open triangles) was in all cases significantly higher than the control (open circles).

Figure 8:
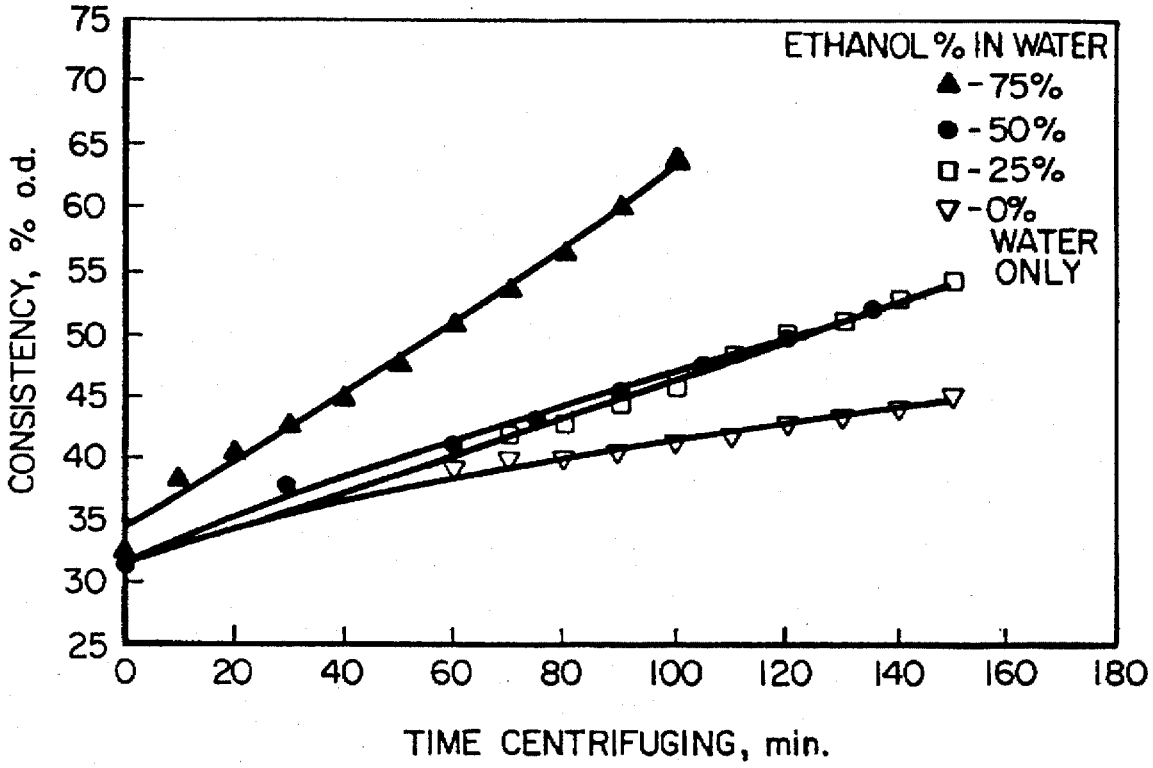
FIG. 8 shows the effect of water and different concentrations of ethanol in the aqueous medium on consistency after centrifuging.

Another important phenomenon noted is illustrated in FIG. 8, namely for a given concentration of ethanol in the surrounding medium the consistency of the pulp after centrifuging was significantly different, i.e. after centrifuging for 150 minutes the maximum consistency when water was the medium was about 45% whereas with 75% ethanol in the surrounding medium the consistency after centrifuging reached almost 65% and that as the concentration of ethanol in the surrounding medium was increased the resultant consistency also increased significantly leading one to conclude that in the presence of ethanol as a dispersing medium one might well easily reach a higher consistency than the 65%. This would reduce the volume of solvent to be handled and the equipment size required.

It will be apparent that the ethanol medium need not be pure ethanol or methanol and combinations of organic solvents may be used.

EXAMPLE 8

For Examples 8 and 9, the apparatus used was a standard rotovap equipment modified with a fritted glass dispersion tube inserted in the rotating round bottom flask. About 10 grams of fluffed unbleached pulp, of approximately 40% consistency was used and an ozone and air mixture was introduced to the dispersion tube at a flow rate of about I liter a minute. The unreacted ozone leaving the flask was captured in a wash bottle filled with a KI solution and the amount of ozone captured in this manner were determined by idometric tritration. The rotation speed of the flask was kept low at a level of about 4 to 5 rpm and the ozonation was performed at room temperature. After ozonation, the pulp was washed with large amounts of tap water, made into a handsheet and air-dried.

The variable in this example is the composition of the ethanol-water medium used for impregnation of washed pulp produced by the ALCELL® process (a process wherein the chips are delignified in an ethanol and water medium). The washed ALCELL®pulp used had a kappa no. of 38.5, and a viscosity 27.3 mPa.s. Six mediums with a weight percentage of ethanol of respectively 0, 10%, 30%, 55%, 70% and 95% were used. The ethanol-water mediums were acidified to a pH of 1.8. After impregnation, the pulp was squeezed to remove excess of the medium, fluffed, transferred at a consistency of about 40% to the flask of the rotovap equipment, and treated with three consecutive stages of ozone treatment.

The kappa number and viscosity of the ozone treated air-dried sheets are summarized in Table 2.

Table 2 shows that the best results were obtained at an ethanol weight percentage of 70%. 95% ethanol was less favourable in terms of delignification indicating that the presence of a certain amount of water is essential to optimize the delignification. Comparison of the results obtained with 0% and 70% ethanol in water shows that in the former case the viscosity drops from 27.3 mPa.s to 7.2 mPa.s, while in the latter a viscosity of 18.7 mPa.s was obtained at the expense of a slightly larger ozone consumption (resp. 2.34 versus 2.57%) and a small loss in delignification (permanganate no. of 5.1 versus 6.3).

TABLE 2

| Ethanol in Water (Weight %) | $O_3$ Supplied (% on o.d. pulp) | $O_3$ Consumed (% on o.d. pulp) | Kappa No. | P. No. | Viscosity (mPa.s) |
|---|---|---|---|---|---|
| 0 | 3.24 | 2.34 | 7.2 | 5.1 | 7.2 |
| 10 | 3.24 | 2.58 | 8.8 | 6.3 | 13.2 |
| 30 | 3.24 | 2.53 | 9.2 | 6.5 | 15.7 |
| 55 | 3.24 | 2.51 | 8.9 | 6.3 | 17.5 |
| 70 | 3.24 | 2.57 | 8.9 | 6.3 | 18.7 |
| 95 | 3.24 | 2.61 | 14.0 | 9.3 | 20.2 |

EXAMPLE 9

In this example the ozonation response of hardwood (a mixture of maple and birch) kraft pulp impregnated with acidified aqueous mixtures of low molecular weight aliphatic alcohols (methanol, ethanol, and ethylene glycol) are reported. The kappa no. and viscosity of the untreated pulp were 14.5 and 30.0 mPa.s (Tappi standard 230 om-82) respectively. The ozone treatment was performed with a 1.08% $O_3$ charge in each of three consecutive ozone stages (except for the third stage with methanol-water as impregnation liquid when the charge was 0.54%). Each stage was carried out at a pH of 1.8, an alcohol weight percentage of 70% for the impregnation liquid (aqueous organic medium), and a consistency of about 40%.

The results are presented in Table 3.

The ozone delignification efficiency in Table 3 shows that the efficiency decreases in the order pure water, then methanol-water followed by ethanol-water and finally ethylene glycol-water. The order of the ozone (lignin-carbohydrate) selectivity is exactly the same as for softwood kraft pulp. The results are shown in Table 3.

Ozonation was terminated after the second stage with pure water as impregnation liquid because of the good delignification efficiency which can be obtained with these two impregnation solutions and the lower kappa no. of 14.5 of the pulp.

TABLE 3

| | Methanol-water | | | Ethanol-water | | | Ethylene-glycol-water | | | Water | | |
|---|---|---|---|---|---|---|---|---|---|---|---|---|
| Stage No. | Kappa No. | P. No. | Viscosity (mPa · s) | Kappa No. | P. No. | Viscosity (mPas · s) | Kappa No. | P. No. | Viscosity (mPa · s) | Kappa No. | P. No. | Viscosity (mPa · s) |
| 1 | 7.8 | 5.6 | 24.8 | 8.6 | 6.1 | 25.9 | 9.3 | 6.7 | 27.3 | 6.4 | 4.6 | 15.1 |
| 2 | 4.1 | 3.0 | 19.1 | 5.8 | 3.1 | 21.8 | 7.2 | 5.2 | 26.6 | 2.4 | 1.8 | 7.2 |
| 3 | 2.4 | 1.8 | 15.2 | 3.8 | 9.8 | 19.1 | 4.4 | 3.2 | 22.1 | | | |

The disclosure has dealt with a number of different organic solvents (primarily with methanol and ethanol) as the organic solvents but, it is believed, other suitable organic solvents of low dialectic constant, i.e. below about 40 will also perform satisfactorily. Applicant has also tried propanol and isopropanol and obtained satisfactory results.

Obviously, the absolute values of the viscosity and kappa no. will reflect the type of pulp being processed, thus the term equivalent to a northern softwood pulp is to be interpreted as requiring suitable scaling of the absolute values normally valid for the other pulp types based on those of northern softwood pulp.

Having described the invention, modifications will be evident to those skilled in the art without departing from the spirit of the invention as defined in the appended claims.

We claim:

1. A method of producing an ozone bleached pulp having a viscosity equivalent to a viscosity of 20 cp for northern softwoods at a permanganate no. of 6 ml comprising pretreating a never dried pulp with an aqueous organic medium consisting essentially of water, a water miscible organic solvent having a dielectric constant of no more than 40 and a mineral acid by thoroughly mixing said pulp and said aqueous organic medium to produce a treated pulp, said aqueous organic medium in said treated pulp containing at least 10% water and at least 10% of said organic solvent and sufficient of said mineral acid to adjust the pH of said treated pulp to a pH of 1.5 to 5, bleaching said treated pulp with ozone in an ozone bleaching stage at said pH in the range of 1.5 to 5 to provide said ozone bleached pulp having a viscosity equivalent to a viscosity of at least 20 cp at a permanganate number of 6 ml for northern softwood pulp.

2. A method as defined in claim 1 wherein said medium comprises at least 50% of said organic solvent in water.

3. A method as defined in claim 2 wherein said medium is selected from the group consisting of methanol in water or ethanol in water.

4. A method as defined in claim 3 wherein said bleaching with ozone is carried out at a consistency of above 30% and said pulp is fluffed before introduction into said ozone bleaching stage.

5. A method as defined in claim 3 further comprising further bleaching said ozone bleached pulp with peroxide to produce a totally chlorine free bleached pulp having an ISO brightness of at least 85% and a viscosity of at least 15 cp.

6. A method as defined in claim 1 wherein said medium comprises at least 70% of said organic solvent in water.

7. A method as defined in claim 6 wherein said medium is selected from the group consisting of methanol in water or ethanol in water.

8. A method as defined in claim 1 wherein said medium is selected from the group consisting of methanol in water or ethanol in water.

9. A method as defined in claim 8 wherein said bleaching with ozone is carried out at a consistency of above 30% and said pulp is fluffed before introduction into said ozone bleaching stage.

10. A method as defined in claim 9 further comprising further bleaching said ozone bleached pulp with peroxide to produce a totally chlorine free bleached pulp having an ISO brightness of at least 85% and a viscosity of at least 15 cp.

11. A method as defined in claim 8 further comprising further bleaching said ozone bleached pulp with peroxide to produce a totally chlorine free bleached pulp having, an ISO brightness of at least 85% and a viscosity of at least 15 cp.

12. A method as defined in claim 1 wherein said bleaching with ozone is carried out at a consistency of above 30% and said pulp is fluffed before introduction into said ozone bleaching stage.

13. A method as defined in claim 12 further comprising further bleaching said ozone bleached pulp with peroxide to produce a totally chlorine free bleached pulp having an ISO brightness of at least 85% and a viscosity of at least 15 cp.

14. A method as defined in claim 1 further comprising further bleaching said ozone bleached pulp with peroxide to produce a totally chlorine free bleached pulp having an ISO-brightness of at least 85% and a viscosity equivalent to a viscosity of at least 15 cp.

* * * * *